US008556642B2

(12) United States Patent
Lai et al.

(10) Patent No.: US 8,556,642 B2
(45) Date of Patent: Oct. 15, 2013

(54) POWER SUPPLY STRUCTURE

(75) Inventors: Yu-Ci Lai, Taoyuan (TW); Chuei-Hang Ciou, Taoyuan (TW); Da-Wei Lee, Taoyuan (TW)

(73) Assignee: Asian Power Devices Inc. (TW)

( * ) Notice: Subject to any disclaimer, the term of this patent is extended or adjusted under 35 U.S.C. 154(b) by 14 days.

(21) Appl. No.: 13/247,367

(22) Filed: Sep. 28, 2011

(65) Prior Publication Data

US 2013/0017705 A1 Jan. 17, 2013

(30) Foreign Application Priority Data

Jul. 15, 2011 (TW) ..... 100125251 A

(51) Int. Cl.
*H01R 29/00* (2006.01)

(52) U.S. Cl.
USPC ..... 439/172; 439/518

(58) Field of Classification Search
USPC ..... 439/170, 171, 172, 173, 518
See application file for complete search history.

(56) References Cited

U.S. PATENT DOCUMENTS

| | | | | |
|---|---|---|---|---|
| 7,597,570 | B2 * | 10/2009 | So | 439/172 |
| 7,632,119 | B1 * | 12/2009 | Ma et al. | 439/172 |
| 8,033,847 | B1 * | 10/2011 | Chen | 439/172 |
| 8,226,424 | B1 * | 7/2012 | Wang et al. | 439/172 |
| 8,313,335 | B2 * | 11/2012 | Wu | 439/172 |

* cited by examiner

*Primary Examiner* — Khiem Nguyen
(74) *Attorney, Agent, or Firm* — Schmeiser, Olsen & Watts LLP

(57) ABSTRACT

A power supply structure includes a main body and a plug. The main body has a circular containing space, a cylinder and a plurality of conducting plates. The cylinder has a retaining plane and at least one annular groove. The plug has a plug seat and a first cylinder. The first cylinder has a protrusion and at least one elastic device on an inner side of the bottom of the first cylinder. The elastic device has a resilient arm and a pressing member. The annular groove has a stop block and a fixing space. The protrusion is provided and placed into the annular groove, so that the plug can be fixed into the main body.

5 Claims, 6 Drawing Sheets

POWER SUPPLY STRUCTURE

CROSS-REFERENCE TO RELATED APPLICATION

This non-provisional application claims priority under 35 U.S.C. §119(a) on Patent Application No(s). 100125251 filed in Taiwan, R.O.C. on Jul. 15, 2011, the entire contents of which are hereby incorporated by reference.

FIELD OF TECHNOLOGY

The present invention relates to a power supply structure, in particular to the power supply structure with a plug capable of selectively fitting different specifications.

BACKGROUND

Most consumer electronic products require a power supply for supplying and charging electric power. However, the power supply comes with various specifications for its applications in different countries, so that a power supply with a plug capable of fitting different specifications to meet its application requirement in different countries is a necessary accessory for businessmen who travel frequently to different countries for commercial activities.

Since the power supply has a specific volume, and the larger the power, the larger is the volume of the power supply, and most utility power panels have a plurality of equidistant sockets, therefore some available spaces of the sockets are occupied by a too-large power supply, and the use of a socket may be wasted. As science and technologies advance, the use of consumer electronic products becomes increasingly more popular, and each consumer electronic device requires a set of power supply, an extension cord with a plurality of sockets is required sometimes. However, the distance between the sockets of the extension cord is very limited, and the space for other sockets is usually occupied by the too-large power supply that causes inconvenience to uses in the application of the power supply. Therefore, a plug capable of fitting sockets of different specifications for the application in different countries was developed, and a power supply with a plug capable of adjusting its direction according to the actual space of a socket is necessary.

SUMMARY

It is a primary objective of the present invention to provide a power supply having a changeable plug, and a special design of this power supply structure allows users to adjust the direction of the plug according to the available space of the sockets.

To achieve the foregoing objective, the present invention provides a power supply structure comprising a main body and a plug, and the main body has a circular containing space, and the circular containing space includes a cylinder and a plurality of conducting plates installed therein, and the cylinder has a retaining plane and at least one annular groove. The plug has a plug seat and a first cylinder, and the first cylinder has at least one protrusion formed on an inner bottom of the first cylinder, and the first cylinder includes at least one elastic device installed therein. The elastic device has a resilient arm and a pressing member, and the annular groove has a stop block and a fixing space, wherein an oblique plane is formed at a position where the protrusion and the stop block are aligned opposite to each other. The protrusion is provided and disposed in the annular groove, so that the elastic device can abut the retaining plane. The first cylinder includes a second cylinder installed therein, and the second cylinder includes a plurality of conducting plates installed therein, and a stop block is disposed between the conducting plates.

To achieve the aforementioned objective, the present invention further provides a power supply structure comprising a main body and a socket. The main body has a retaining plane, a circular containing space disposed at the middle of the retaining plane, a plurality of conducting plates installed in the circular containing space, and at least one annular groove. The plug has a plug seat and a cylinder, and the cylinder has at least one protrusion formed on an inner bottom of the cylinder, and at least one elastic device installed on a side of the plug seat, wherein the elastic device is in an arch shape. The protrusion is disposed in the annular groove, so that the elastic device can abut the retaining plane.

Although the elastic device structures of the aforementioned two preferred embodiments are slightly different, the two elastic device structures are interchangeable and not limited to their use in any one embodiment only.

BRIEF DESCRIPTION

DETAILED DESCRIPTION

The objects, characteristics and effects of the present invention will become apparent with the detailed description of the preferred embodiments and the illustration of related drawings as follows.

Figure 1:
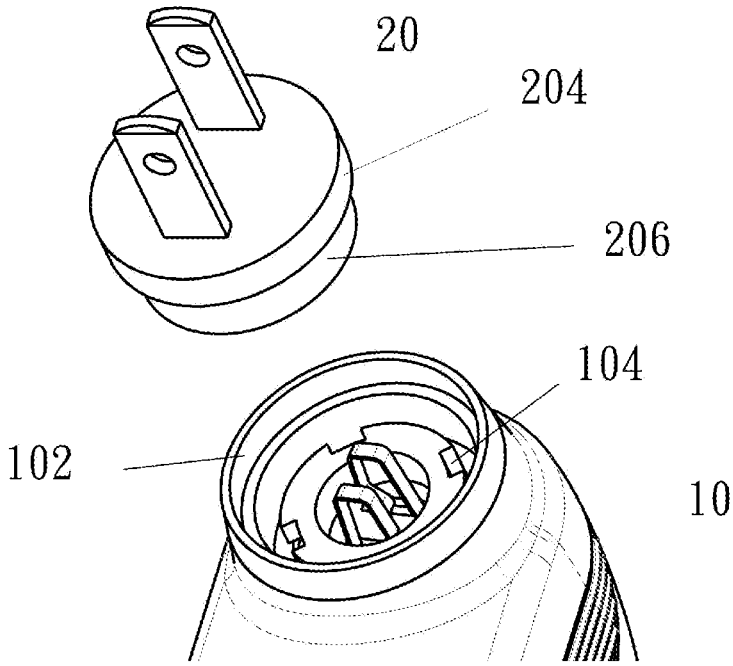
FIG. 1 is a perspective view of a power supply in accordance with a preferred embodiment of the present invention.

With reference to FIG. 1 for a power supply in accordance with a preferred embodiment of the present invention, the power supply comprises a main body 10 and a plug 20, wherein the main body 10 includes a circular containing space 102.

Figure 2:
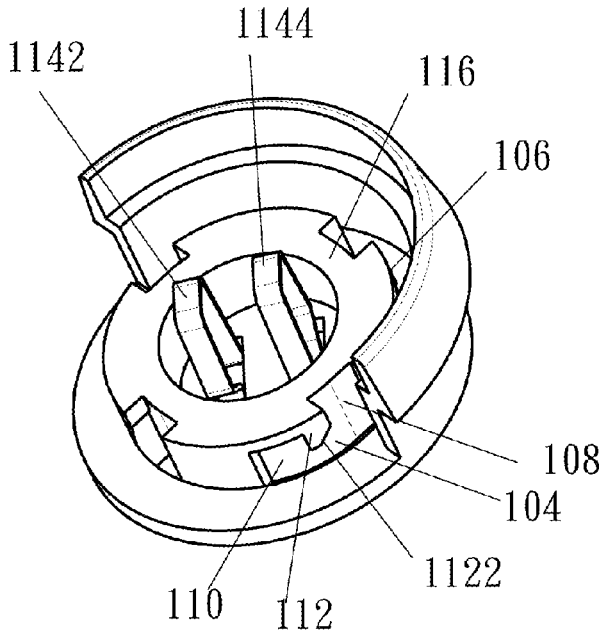
FIG. 2 is a perspective view of a containing space of a main body in accordance with a preferred embodiment of the present invention.

With reference to FIG. 2 for a perspective view of a containing space 102 of a main body in accordance with a preferred embodiment of the present invention, the circular containing space 102 includes a cylinder 106 and a plurality of conducting plates 1142, 1144. The cylinder 106 includes a retaining plane 116 formed on a side of the cylinder 106, and one or more annular grooves 104 formed on a lateral side of the cylinder 106, wherein the annular groove 104 includes an opening 108 formed thereon and interconnected to the retaining plane 116, a stop block 112 formed on a side of the annular groove 104, a fixing space 110 defined on another side of the stop block 112 and aligned opposite to the opening 108, and an oblique plane 1122 formed on the stop block and proximate to the opening 108.

Figure 3:
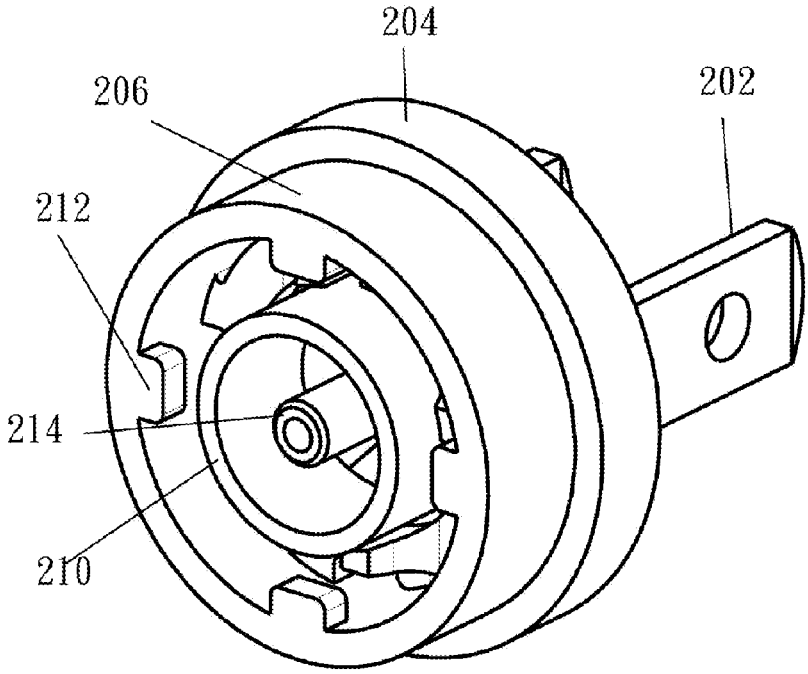
FIG. 3 is a perspective view of a plug in accordance with a preferred embodiment of the present invention.
Figure 7:
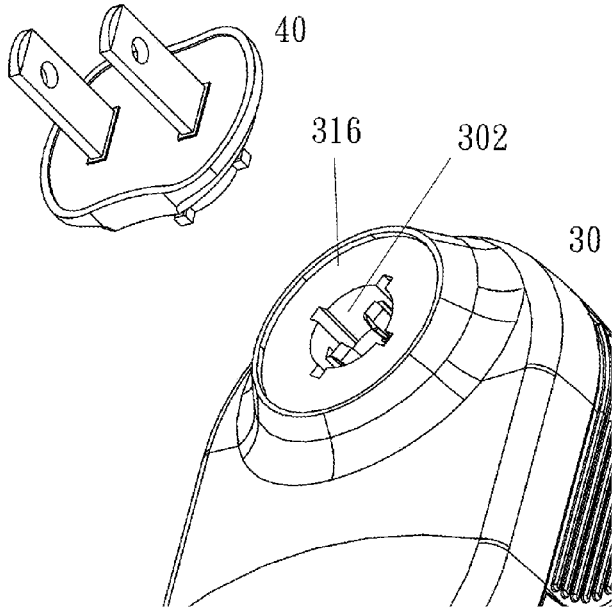
FIG. 7 is a perspective view of a power supply in accordance with another preferred embodiment of the present invention.

With reference to FIG. 3 for a perspective view of the internal structure of the plug 20, the plug 20 includes a plug seat 204, a plurality of pins 202 and a first cylinder 206. The first cylinder 206 has one or more protrusions 212 formed on an inner bottom of the first cylinder 206, and an oblique plane 2122 formed on a side of the protrusion 212 (as shown in FIG. 7), and the first cylinder 206 has a second cylinder 210 coaxially installed therein, and the second cylinder 210 has an isolation column 214 installed therein.

Figure 4:
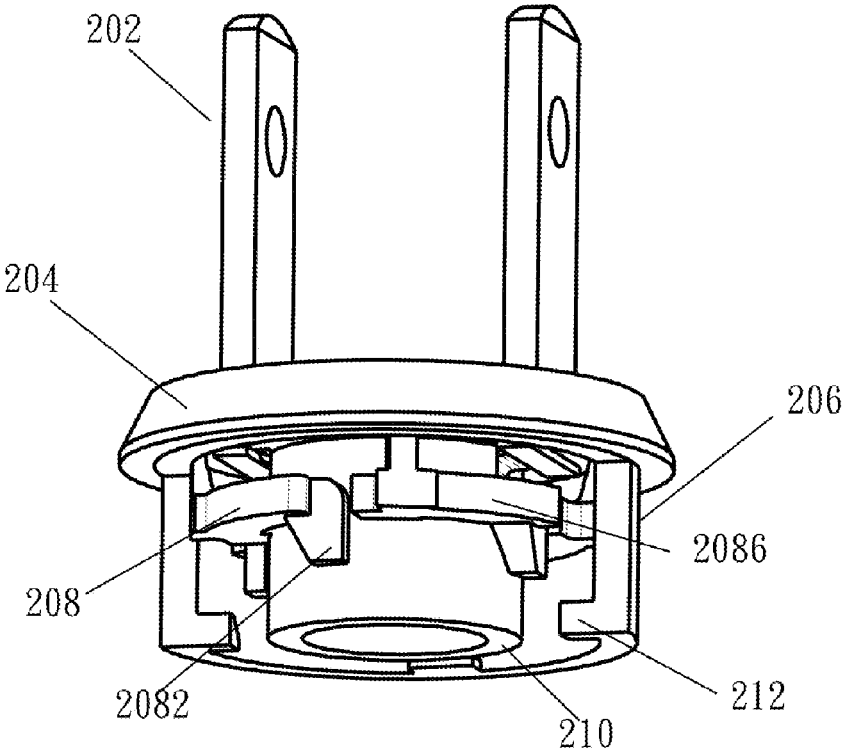
FIG. 4 is a front view of a plug in accordance with a preferred embodiment of the present invention.
Figure 5:
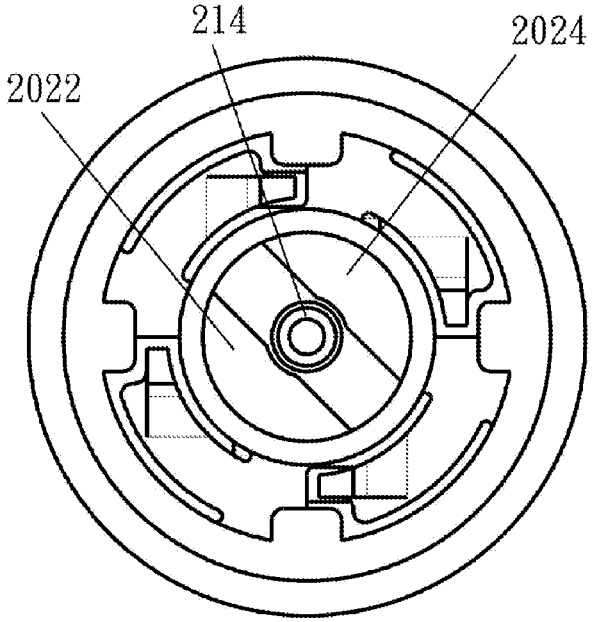
FIG. 5 is a bottom view of a plug in accordance with a preferred embodiment of the present invention.
Figure 6:
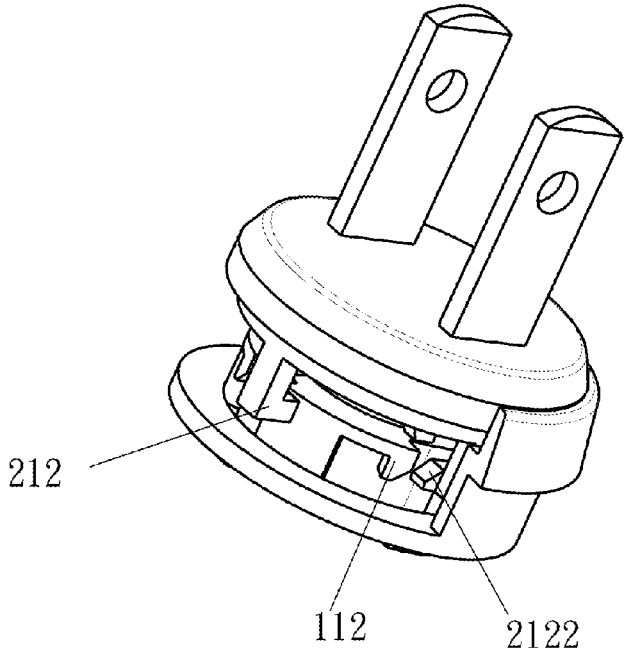
FIG. 6 is a perspective view of a plug coupled to a containing space of a main body in accordance with a preferred embodiment of the present invention.

With reference to FIG. 4, the first cylinder 206 has one or more elastic devices 208 installed therein, and the elastic device 208 has a pressing member 2082 and a resilient arm 2086. An end of the elastic device is fixed to the first cylinder 206, such that when a force is applied to the pressing member 2082, the resilient arm 2086 elastically moves in a specific direction. The second cylinder 210 has a plurality of conducting plates 2022, 2024 installed therein, and an isolation column 214 installed between the conducting plates 2022, 2024 and respectively and electrically coupled to the pins 202 (as shown in FIG. 5).

In FIGS. 2, 3, 4 and 6, when the plug 20 and the main body 10 are coupled with each other, the protrusion 212 of the plug 20 is placed into an opening 108 of the annular groove 104 of the main body 10. Now, the pressing member 2082 of the elastic device 208 abuts the retaining plane 116 of the cylinder 106. If it is necessary to fix the plug 20 to the main body 10, a downward force is exerted onto the plug 20 to move the resilient arm 2086 of the elastic device 208, and the protrusion 212 of the plug 20 can be placed at the bottom of the annular groove 104. Meanwhile, the plug 20 is turned to slide the protrusion 212 through the stop block 112 and placed into the fixing space 110. Now, the pressure exerted onto the plug 20 is released to resume the resilient arm 2086 to its original position, and the stop block 112 is provided for fixing the protrusion 212, so that the plug 20 can be fixed into the circular containing space 102 of the main body. An oblique plane is defined on a side where the stop block 112 and the protrusion 212 are aligned opposite to each other, so that the plug 20 can be turned into the annular groove 104 easily with less effort.

When use, the space of the power socket is limited, and if some of the sockets cannot be used, the plug 20 can be removed and the main body 10 can be turned by 90 degrees in order to fully use the power supply in the limited space.

With reference to FIG. 7 for a power supply in accordance with another preferred embodiment of the present invention, the power supply comprises a main body 30 and a plug 40, wherein the main body 30 has a retaining plane 316, and a circular containing space 302 formed at the middle of the retaining plane.

Figure 8:
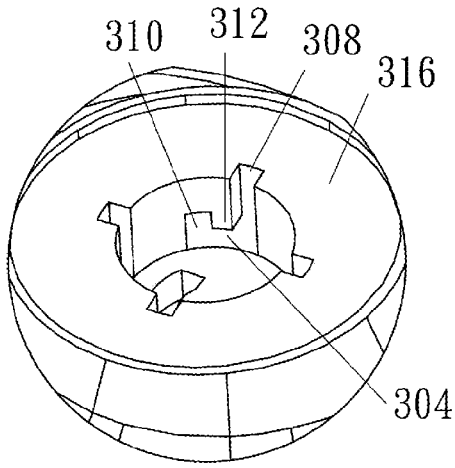
FIG. 8 is a perspective view of a containing space of a main body in accordance with another preferred embodiment of the present invention.

With reference to FIG. 8 for a perspective view of the internal structure of the circular containing space 302, the circular containing space 302 has one or more annular grooves 304 formed on a side of the circular containing space 302, and the annular groove 304 has an opening 308 interconnected to the retaining plane 316 and a stop block 312 formed on a side of the annular groove 304, and a fixing space 310 is formed on another side of the stop block 312 and aligned opposite to the opening 308.

Figure 9:
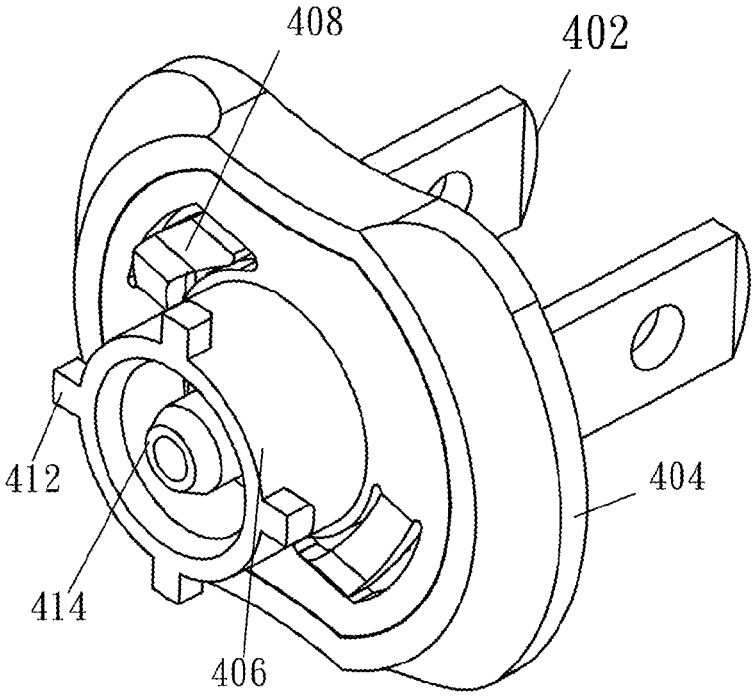
FIG. 9 is a perspective view of a plug of a power supply in accordance with another preferred embodiment of the present invention.
Figure 10:
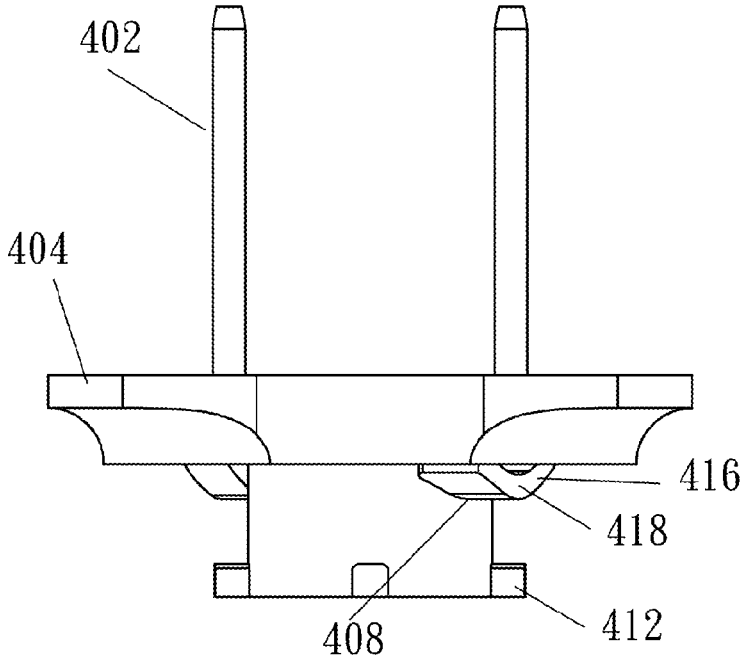
FIG. 10 is a front view of a plug in accordance with a preferred embodiment of the present invention.
Figure 11:
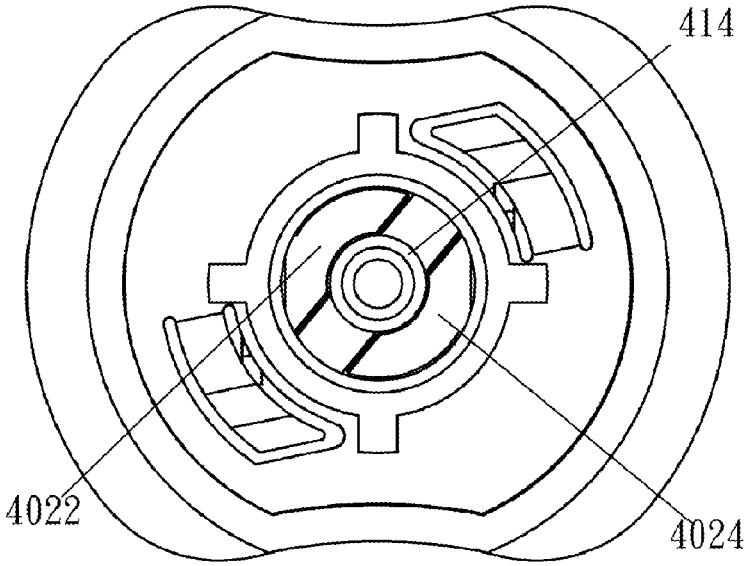
FIG. 11 is a bottom view of a plug in accordance with a preferred embodiment of the present invention.

With reference to FIGS. 9 and 10 for a plug of a power supply in accordance with another preferred embodiment of the present invention, the plug 40 comprises a plug seat 404, a plurality of pins 402 and a cylinder 406. The cylinder 406 has one or more protrusions 412 disposed on an outer bottom of the cylinder 406, a plurality of conducting plates installed in the cylinder 406, and an isolation column 414 installed between the conducting plates 4022, 4024 (as shown in FIG. 11) and electrically coupled to the plurality of pins 402. One or more elastic devices 408 are installed on a side of the plug seat 404, and each elastic device 408 is in an arch shape, and a pressing point 418 is situated at the vertex of the arch shape, and an end of the elastic device 408 is fixed to the plug seat 404, and a resilient arm 416 is defined by the distance from the fixed end to the pressing point 418. When the pressing point 418 is pressed by a force, the resilient arm 416 is elastically moved in a specific direction.

Although the elastic device structures of the aforementioned two preferred embodiments are slightly different, the two elastic device structures are interchangeable and not limited to the use in any one of the embodiments only.

What is claimed is:

1. A power supply structure, comprising:

a main body, having a circular containing space, and the circular containing space having a cylinder and a plurality of first conducting plates, and the cylinder having a retaining plane and at least one annular groove, wherein the plurality of first conducting plates are installed within the cylinder; and a plug, having a plug seat, a first cylinder, and a second cylinder, the first cylinder having at least one protrusion formed thereon, and at least one elastic device installed therein, the second cylinder includes a plurality of second conducting plates installed therein;

wherein the protrusion is placed in the annular groove, so that the elastic device can abut the retaining plane, and when the main body is combined with the plug, the plurality of first conducting plates is contacted with the second plurality of conducting plates.

2. The power supply structure of claim 1, further comprising an isolation column installed between the plurality of second conducting plates.

3. The power supply structure of claim 2, wherein the elastic device has a resilient arm and a pressing member.

4. The power supply structure of claim 3, wherein the annular groove has a stop block and a fixing space.

5. The power supply structure of claim 4, wherein an oblique plane is formed on the at least one protrusion and an oblique plane is formed on the stop block.

* * * * *